US006612452B2

(12) United States Patent
Heilner

(10) Patent No.: US 6,612,452 B2
(45) Date of Patent: Sep. 2, 2003

(54) BOTTLE BIB

(76) Inventor: Holly M. Heilner, 12774 Shawnee Rd., Greenwood, DE (US) 19950

( * ) Notice: Subject to any disclaimer, the term of this patent is extended or adjusted under 35 U.S.C. 154(b) by 0 days.

(21) Appl. No.: 09/934,583

(22) Filed: Aug. 23, 2001

(65) Prior Publication Data

US 2003/0038104 A1 Feb. 27, 2003

(51) Int. Cl.[7] ..... A61J 9/08
(52) U.S. Cl. ..... 215/392; 215/11.6
(58) Field of Search ..... 215/6, 42, 43, 215/392, 11.6; 220/903

(56) References Cited

U.S. PATENT DOCUMENTS

| | | | | |
|---|---|---|---|---|
| 134,302 | A | | 12/1872 | Miller |
| 445,569 | A | | 2/1891 | Morningstar |
| 447,635 | A | | 3/1891 | Day, Jr. |
| 1,182,993 | A | | 5/1916 | Deeks |
| 1,449,335 | A | | 3/1923 | Latham |
| 1,939,777 | A | * | 12/1933 | Humboldt ..... 215/12.1 |
| 2,081,409 | A | | 5/1937 | Rush |
| 2,409,820 | A | * | 10/1946 | Zimmern ..... 215/11.6 |
| 2,509,129 | A | * | 5/1950 | Buck ..... 215/11.6 |
| 3,063,590 | A | * | 11/1962 | Hopkins ..... 215/392 |
| 3,065,944 | A | * | 11/1962 | Liebendorfer ..... 215/11.6 |
| 3,696,965 | A | | 10/1972 | Napper |
| 4,282,279 | A | * | 8/1981 | Strickland ..... 215/12.1 |
| 4,401,245 | A | * | 8/1983 | Zills ..... 215/12.1 |
| 4,437,583 | A | | 3/1984 | O'Connor |
| 4,473,907 | A | * | 10/1984 | Maillard ..... 215/11.6 |
| 5,188,877 | A | * | 2/1993 | Magaro ..... 220/903 |
| 5,415,305 | A | * | 5/1995 | Drake-Tipton et al. ..... 215/392 |

* cited by examiner

*Primary Examiner*—Stephen K. Cronin
*Assistant Examiner*—Tri M. Mai
(74) *Attorney, Agent, or Firm*—Hall, Priddy, Myers & Vande Sande

(57) ABSTRACT

Apparatus for attachment to drinking vessels, such as baby bottles, which is designed to absorb excess liquid beverage which is rejected by the drinker of such beverage (e.g. "spit up" by a baby) or spilled or dripped from the drinking vessel.

5 Claims, 2 Drawing Sheets

BOTTLE BIB

FIELD OF THE INVENTION

This invention relates generally to apparatus for attachment to drinking vessels, such as baby bottles, which is designed to absorb excess liquid beverage which escapes from the mouth of the drinker (e.g. a baby) or is spilled or dripped from the drinking vessel.

BACKGROUND OF THE INVENTION

It is well known to any parent that when a baby drinks from a baby bottle, a substantial amount of liquid which is dispensed from the bottle ends up on the baby's chin, neck, and/or clothing. Although this occurs primarily with newborn babies, it may continue at least until the baby reaches three months old and, in some circumstances, further along in the age of the baby.

Liquid which is "spilled" in this manner can not only wet or soil the baby's garments (and oftentimes the person feeding the baby) but, when it occurs, also leaves the person feeding the baby with an difficult choice. Because babies often fall asleep while feeding, a person feeding a baby must decide whether to put the baby to bed with wet garments or risk waking the child while changing the baby's clothes. Leaving the child to sleep in wet clothes can, of course, cause irritation to the baby's typically sensitive skin.

One known but inadequate solution to these problems in the art is the use of a bib tied around the child's neck during bottle feeding. Conventional bibs are not effective in solving the aforementioned problems, however, because the beverage dispensed from a bottle typically runs down the chin and neck of the baby and then under the surface of the bib. Furthermore, utilizing a conventional bib subjects the feeder (e.g. mother, etc.) to the potential difficultly of untying and removing a bib without waking a baby who has fallen asleep.

Therefore, prior to the subject invention described herein, a person bottle feeding a baby was required to repeatedly attend to the cleaning or wiping up of the excess liquid dispensed from a baby bottle (which has flowed onto the chin, neck, etc . . . of a feeding baby), or suffer the problems associated therewith.

In view of the above, it is apparent that there exists a need in the art for apparatus which may be attached to a baby bottle or other drinking vessel which overcomes the above described problems in the art. It is a purpose of this invention to fulfill this need in the art, as well as other needs which will become apparent to the skilled artisan once given the following disclosure.

SUMMARY OF THE INVENTION

Generally speaking, this invention fulfills the above described needs in the art by providing: an apparatus for attachment to a drinking vessel comprising:

a first member, the first member comprising a first absorbent layer and including a chin contacting portion;

a securing member for securing the first member to a drinking vessel such that the chin contacting portion protrudes a distance from the drinking vessel.

In another embodiment, there is provided: an apparatus for attachment to a drinking vessel comprising:

a first member comprising at least a first absorbent layer;

a securing member for securing the first member to a drinking vessel; and wherein the first member is so shaped and sized such that when the first member is secured to a drinking vessel by the securing member, the first member protrudes from the drinking vessel a distance such that the first member is positionable under the chin of a person drinking from the drinking vessel.

In yet another embodiment, there is provided: an apparatus for attachment to a drinking vessel comprising:

means for absorbing liquid;

means for securing the means for absorbing liquid to a drinking vessel such that the means for absorbing liquid protrudes a distance from the drinking vessel.

IN THE DRAWINGS

DETAILED DESCRIPTION OF CERTAIN EMBODIMENTS

Figure 1:
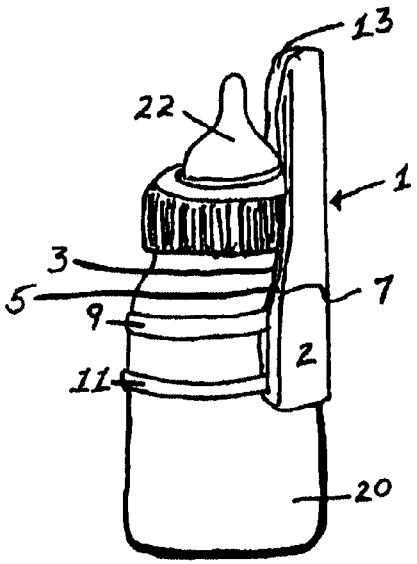
FIG. 1 is a three-dimensional side view of one embodiment of the subject invention illustrated as employed on a baby bottle.
Figure 3:
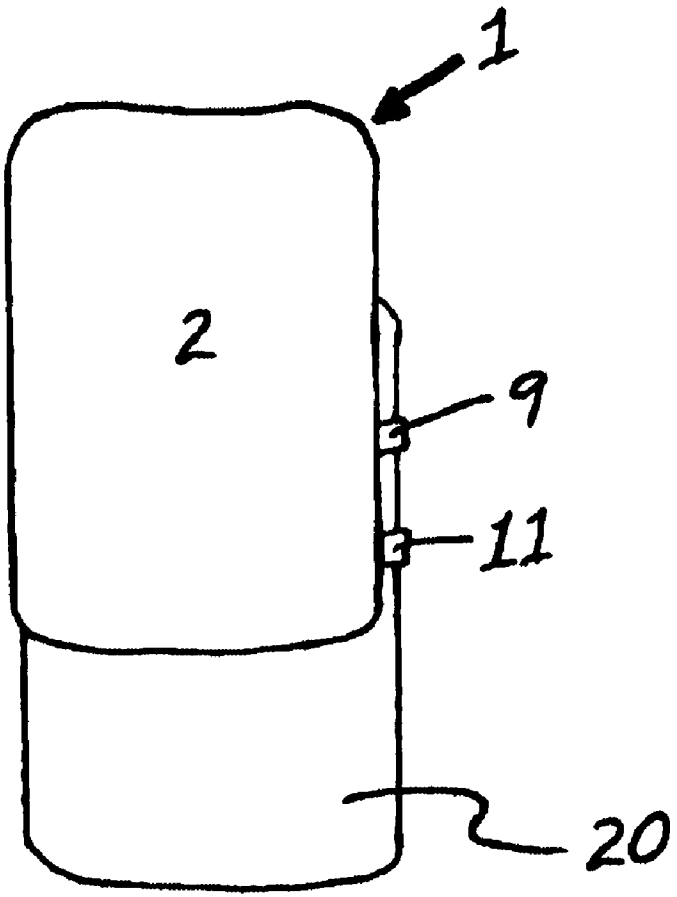
FIG. 3 is a rearward perspective view of the embodiment illustrated in FIG. 1

Referring initially to FIGS. 1 and 3, therein is illustrated one exemplary embodiment of the subject invention which solves the various above-described problems of the prior art. More specifically, apparatus 1 is shown which comprises a first member 2 including a plurality of layers comprising a first absorbent fabric layer 3, a first non-absorbent layer 5, and a second absorbent fabric layer 7. As is illustrated, each of these layers is fixed in contact with the adjoining layer, with non-absorbent layer 5 disposed between the two absorbent layers. These layers (3, 5, and 7), as shown, are fixed to each other via conventional double-sided adhesive tape, however, any known means of securing the layers together, such as stitching or glue will suffice.

Absorbent layers 3 and 7 may be any absorbent and preferably durable material (synthetic or natural) as long as such material is suitable for the purpose herein at hand. One particularly effective material, however, is manufactured by Georgia Pacific under the trade name AIRTEXT™, and is available through normal merchant channels.

Non-absorbent layer 5 may additionally be selected from suitable known materials, the purpose of such layer being merely to provide structural support to the absorbent apparatus 1 and, in some embodiments, to prevent liquid from transferring from one absorbent layer to the other. In this respect, in some embodiments, layer 5 is a liquid impermeable layer. One example of a material which is known to be suitable as such a layer is a conventional soft plastic such as polyurethane.

Figure 2:
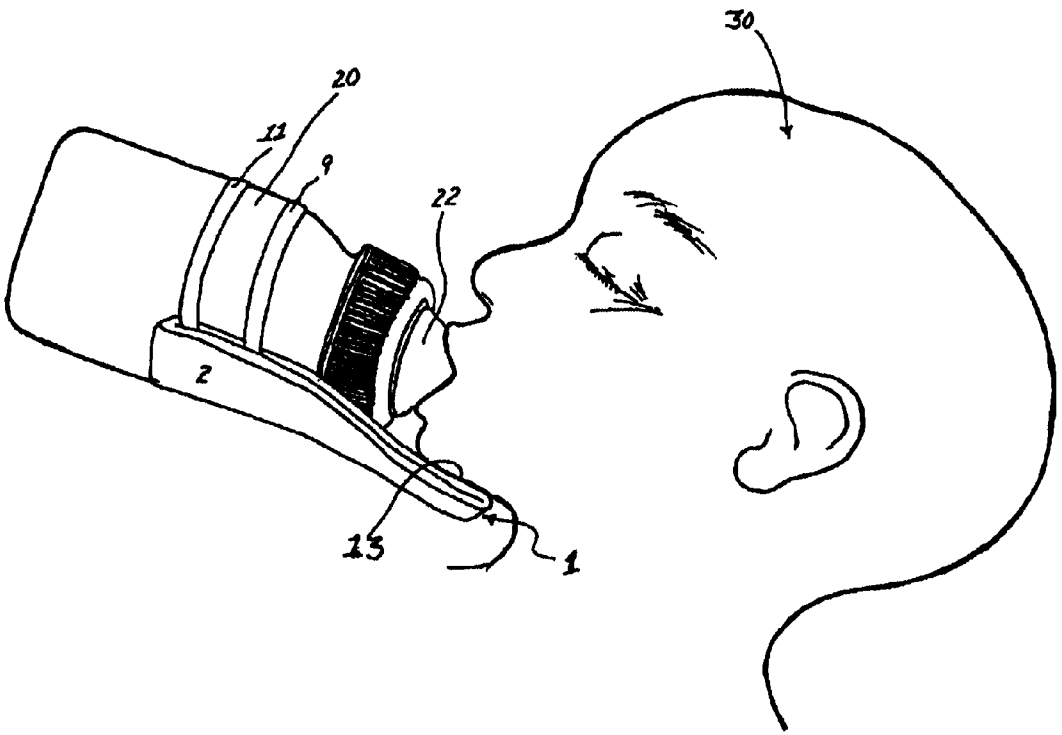
FIG. 2 is a side view of the embodiment of FIG. 1 shown in use during a bottle feeding.

In order to secure apparatus 1 to a drinking vessel such as a baby bottle 20 illustrated in FIGS. 1 and 2, a pair of elastic bands 9 and 11 are provided. These bands may be adhesively secured between any two of the layers 3, 5, or 7, or, alternatively, may be simply stitched or glued to the edges of absorbent apparatus 1. Furthermore, bands 9 and 11 may be eliminated altogether (or only one band used) and alternative means employed to secure apparatus 1 to a drinking vessel (e.g. double-sided tape, glue, or permanent affixation).

Employed as such, however, elastic bands 9 and 11 should be adjusted such that their length is appropriate to frictionally fit and hold apparatus 1 to a circumference of baby bottle 20 (e.g. or other drinking vessel). In particular, apparatus 1 should be attached such that a chin contacting portion 13 protrudes a distance away from and underneath the nipple 22 of the baby bottle 20 such that when the nipple 22 is placed in the mouth of a baby 30 (see FIG. 2), the chin contacting portion 13 will be positioned underneath and preferably in contact with a portion of the chin of the baby. In such a position, if the baby rejects (e.g. dribbles, drools, spills, etc.) any portion of the liquid contained in the bottle, or if any liquid drips from the nipple 22 of the bottle 20, any liquid which would otherwise flow down the chin (or simply drip onto the baby or the adult feeding the baby) will be absorbed, at least in part, by the absorbent layers (3 and/or 7) of the absorbent apparatus 1. Therefore, many of the messes associated with bottle feeding are substantially eliminated with both the baby, the baby's clothes, and the clothes of the feeding adult being protected from many of the liquid spills which otherwise normally occur during a bottle feeding.

In some embodiments of the subject invention, absorbent layers 3 and 7 may be selectively replaced without replacing the whole apparatus 1. Such replacement is easiest, of course, in embodiments which employ double-sided adhesive tape to secure the adjacent layers to each other. In such embodiments, an individual layer may be removed (if it is soiled for example) and a new layer placed thereon and fixed with a new strip of adhesive.

In other embodiments of the subject invention, additional layers may be employed which are either absorbent or non-absorbent.

In still other embodiments, apparatus 1 may comprise only a single material or layer (with absorbent qualities), or a bi-layer (e.g. one absorbent layer and one nonabsorbent layer).

Although the description herein has so far only been described with respect to baby bottles, other uses are contemplated to be within the scope of the subject invention. For example, apparatus 1 and elastic bands 9 and 11 may be so sized and shaped so as to fit on a childrens training cup, or even on a normal glass (e.g. to be used by children or by physically challenged adults). In this respect, apparatus 1 and the means to secure it to a drinking vessel may be adapted in any number of ways to be configurable to attach to a nearly infinite number of drinking vessel types.

Once given the above disclosure, many other features, modifications, and improvements will become apparent to the skilled artisan. Such other features, modifications, and improvements are therefore considered to be part of this invention, the scope of which is to be determined by the following claims:

I claim:

1. In combination, a drinking vessel including a liquid retaining portion having a circumference and having a first end and a second end and comprising at least one wall, said drinking vessel having a nipple extending from said first end of said liquid retaining portion for extracting liquid therefrom; and an absorbent apparatus removably attached to said at least one wall, wherein the improvement comprises an absorbent apparatus comprising:

a substantially planar absorbent member having an attaching end and an absorbent end, said attaching end being removably attached to said liquid retaining portion at a point between a midpoint of said liquid retaining portion and said first end of said liquid retaining portion, said absorbent end extending from said attaching end forming a substantially curvilinear, planar absorbing surface which is both substantially firm so as to be self-supporting and flexible so as to conform to a chin, said absorbent end extending substantially co-parallel to said nipple and terminating substantially proximally in line with an end thereof;

means for removably attaching said absorbent apparatus to said drinking vessel; and wherein said substantially planar absorbent member is substantially rectangular and is so sized such that, when attached to said drinking vessel, said substantially planar absorbing member, in its width, covers an amount of surface of said liquid retaining portion comprising no more than 50 percent of said circumference.

2. The combination of claim 1 wherein said substantially planar absorbent member further comprises:

a first absorbent layer;

a non-absorbent layer having first and second surfaces, said first surface being in substantially continuous contact with said first absorbent layer; and a second absorbent layer in substantially continuous contact with said second surface of said non-absorbent layer.

3. The conformation of claim 2 wherein said non-absorbent layer is substantially impermeable to liquid.

4. The combination of claim 2 wherein said means for removably attaching said absorbent apparatus comprises at least one elastic band.

5. The combination of claim 2 wherein said means for removably attaching said absorbent apparatus comprises an adhesive.

* * * * *